US005597508A

United States Patent [19]

Schepers et al.

[11] Patent Number: 5,597,508

[45] Date of Patent: Jan. 28, 1997

[54] LIQUID DETERGENT COMPOSITION CONTAINING DEFLOCCULATING POLYMER WITH IONIC MONOMERS

[75] Inventors: Frederik J. Schepers, Ridgewood, N.J.; Peter G. Montague, Dunchurch, Great Britain

[73] Assignee: Lever Brothers Company, Division of Conopco, Inc., New York, N.Y.

[21] Appl. No.: 566,590

[22] Filed: Dec. 4, 1995

Related U.S. Application Data

[63] Continuation of Ser. No. 257,228, Jun. 9, 1994, abandoned, which is a continuation of Ser. No. 849,393, filed as PCT/EP90/01817, Oct. 23, 1990, published as WO91/06623, May 16, 1991, abandoned.

[30] Foreign Application Priority Data

Oct. 31, 1989 [GB] United Kingdom ..... 8924478

[51] Int. Cl.[6] ..... C11D 3/37; C11D 17/00

[52] U.S. Cl. ..... 510/417; 510/426; 510/433; 510/421

[58] Field of Search ..... 252/174.23, 174.24, 252/DIG. 2, 174.21, 174, DIG. 14, 173

[56] References Cited

U.S. PATENT DOCUMENTS

| | | | |
|---|---|---|---|
| 4,061,602 | 12/1977 | Oberstar et al. | 252/547 |
| 4,244,840 | 1/1981 | Straw | 252/540 |
| 4,676,978 | 6/1987 | Cseh | 424/70.15 |
| 5,073,285 | 12/1991 | Liberati et al. | 252/94 |
| 5,108,644 | 4/1992 | Machin et al. | 252/174.23 |
| 5,147,576 | 9/1992 | Montague et al. | 252/174 |

FOREIGN PATENT DOCUMENTS

| | | |
|---|---|---|
| 0038101 | 10/1981 | European Pat. Off. . |
| 140452 | 5/1985 | European Pat. Off. . |
| 0151884 | 8/1985 | European Pat. Off. . |
| 0160342 | 11/1985 | European Pat. Off. . |
| 0301883 | 2/1989 | European Pat. Off. . |
| 0301882 | 2/1989 | European Pat. Off. . |
| 346995 | 12/1989 | European Pat. Off. . |
| 0415698 | 3/1991 | European Pat. Off. . |
| 9106623 | 5/1991 | WIPO . |
| 9108281 | 6/1991 | WIPO . |
| 9109109 | 6/1991 | WIPO . |
| 9108280 | 6/1991 | WIPO . |
| 9109932 | 7/1991 | WIPO . |

OTHER PUBLICATIONS

International Search Report for PCT/EP90/01817, Apr. 4, 1991.

*Primary Examiner*—Ardith Hertzog
*Attorney, Agent, or Firm*—Ronald A. Koatz

[57] ABSTRACT

A liquid detergent composition comprising a dispersion of lamellar droplets in an aqueous continuous phase and a polymer consisting of nonionic monomers and ionic monomers wherein the ionic groups constitute from 0.1 to 50% by weight of the polymer, and wherein the equivalent composition, minus the polymer has a significantly higher viscosity and/or becomes unstable.

2 Claims, No Drawings

LIQUID DETERGENT COMPOSITION CONTAINING DEFLOCCULATING POLYMER WITH IONIC MONOMERS

This is a Continuation application Ser. No. 08/257,228, filed Jun. 9, 1994, now abandoned, which is a Continuation application of Ser. No. 07/849,393, filed as PCT/EP90/01817 Oct. 23, 1990 and published as WO91/06623 May 16, 1991, now abandoned.

The present invention relates to liquid detergent compositions, in particular to liquid detergent compositions which comprise a dispersion of lamellar droplets in an aqueous continuous phase.

Lamellar droplets are a particular class of surfactant structures which, inter alia, are already known from a variety of references, e.g. H. A.Barnes, 'Detergents', Ch. 2. in K. Walters (Ed), 'Rheometry: Industrial Applications', J. Wiley & Sons, Letchworth 1980.

Such lamellar dispersions are used to endow properties such as consumer-preferred flow behaviour and/or turbid appearance. Many are also capable of suspending particulate solids such as detergency builders or abrasive particles. Examples of such structured liquids without suspended solids are given in U.S. Pat. No. 4,244,840, whilst examples where solid particles are suspended are disclosed in specifications EP-A-160 342; EP-A-38 101; EP-A-140 452 and also in the aforementioned U.S. Pat. No. 4,244,840. Others are disclosed in European Patent Specification EP-A-151 884, where the lamellar droplet are called 'spherulites'.

The presence of lamellar droplets in a liquid detergent product may be detected by means known to those skilled in the art, for example optical techniques, various rheometrical measurements. X-ray or neutron diffraction, and electron microscopy.

The droplets consist of an onion-like configuration of concentric bi-layers of surfactant molecules, between which is trapped water or electrolyte solution (aqueous phase). Systems in which such droplets are close-packed provide a very desirable combination of physical stability and solid-suspending properties with useful flow properties.

A problem in formulating detergent compositions of high lamellar phase volume is a possible instability and/or high viscosity of the product. These problems are fully described in our co-pending European patent application 89201530.6 (EP346 995).

We have now found that the dependency of stability and/or viscosity upon volume fraction can be favourably influenced by incorporating into a lamellar detergent composition a deflocculating polymer consisting of substantially nonionic monomers and of ionic monomers, wherein the ionic monomers constitute from 0.1 to 50% by weight of the polymer.

The ionic groups in the ionic monomers may be present as side groups to the polymer backbone but it is also possible that they are part of the polymer backbone.

Accordingly the present invention relates to a liquid detergent composition comprising a dispersion of lamellar droplets in an aqueous continuous phase and from 0.01 to 5.0% by weight of the composition of a viscosity reducing and/or stabilizing polymer consisting of nonionic monomers and ionic monomers wherein the ionic monomers constitute from 0.1 to 50% by weight of the polymer.

The deflocculating polymer allows, if desired, the incorporation of greater amounts of surfactants and/or electrolytes than would otherwise be compatible with the need for a stable, low-viscosity product. It also allows (if desired) incorporation of greater amounts of certain other ingredients to which, hitherto, lamellar dispersions have been highly stability-sensitive. Further details of these are given hereinbelow.

The present invention allows formulation of stable, pourable products wherein the volume fraction of the lamellar phase is 0.5–0.6 or higher, but with combinations or concentrations of ingredients not possible hitherto. A method of determining the volume fraction of the lamellar phase is described in our copending European patent application 89201530.6 (EP346 995).

Generally, it is preferred for the compositions of the present invention to have solid-suspending properties (i.e. capable of suspending solid particles).

EP301 882 discloses structured liquid detergents comprising a viscosity reducing polymer.

In practical terms, i.e. as determining product properties, the term 'deflocculating' in respect of the polymer means that the equivalent composition, minus the polymer, has a significantly higher viscosity and/or becomes unstable. It is not intended to embrace polymers which would increase the viscosity but not enhance the stability of the composition. It is also not intended to embrace polymers which would lower the viscosity simply by a dilution effect, i.e. only by adding to the volume of the continuous phase. Nor does it include those polymers which lower viscosity only be reducing the volume fraction (shrinking) of the lamellar droplets, as disclosed in our European patent Application EP301 883. Thus, although within the ambit of the present invention, relatively high levels of the deflocculating polymers can be used in those systems where a viscosity reduction is brought about; typically levels as low as from about 0.01% by weight to about 1.0% by weight can be capable of considerably reducing the viscosity at 21 $s^{-1}$. Preferably the reduction in viscosity at 21$s^{-1}$ and a polymer level of 1.0% by weight is more than 10%, more preferred more than 20%, especially preferred more than 30%.

Especially preferred embodiments of the present invention exhibit less phase separation on storage and have a lower viscosity than an equivalent composition without any of the deflocculating polymer. Preferably compositions of the present invention will yield no more than 10%, more preferred no more than 5%, especially preferred no more than 2% by volume phase separation as evidenced by appearance of 2 or more phases when stored at 25° C. for 21 days from the time of preparation. The viscosity of compositions according to the invention is preferably less than 3.5 Pas, more preferably less than 2.5 Pas and especially not greater than 1500 mPas at a shear rate of 21 s–1.

Without being bound by any particular interpretation or theory, the Applicants have hypothesised that the polymers exert their action on the composition by the following mechanism. The ionic group(s) could be situated onto the outer bi-layer of the lamellar droplets, leaving the nonionic groups over the outside of the droplets and/or the polymers could be incorporated deeper inside the droplet. When the ionic groups are situated onto the outer bilayer of the droplets, this has the effect of decoupling the inter- and intra-droplet forces i.e. the difference between the forces between individual surfactant molecules in adjacent layers within a particular droplet and those between surfactant molecules in adjacent droplets could become accentuated in that the forces between adjacent droplets are reduced. This will generally result in an increased stability due to less flocculation and a decrease in viscosity due to smaller forces between the droplets resulting in greater distances between adjacent droplets.

When the polymers are incorporated deeper inside the droplets also less flocculation will occur, resulting in an increase in stability. The influence of these polymers within the droplets on the viscosity is governed by two opposite effects: firstly the presence of deflocculating polymers will decrease the forces between adjacent droplets resulting in greater distances between the droplets, generally resulting in a lower viscosity of the system; secondly the forces between the layers within the droplets are equally reduced by the presence of the polymers in the droplet, this generally result in an increase in the layer thickness, therewith increasing the lamellar volume of the droplets, therewith increasing the viscosity. The net effect of these two opposite effects may result in either a decrease or an increase in the viscosity of the product.

The composition according to the invention may contain only one, or a mixture of deflocculating polymer types. The term 'polymer types' is used because, in practice, nearly all polymer samples will have a spectrum of structures and molecular weights and often impurities. Thus, any structure of deflocculation polymers described in this specification refers to polymers which are believed to be effective for deflocculation purposes as defined hereabove. In practice these effective polymers may constitute only part of the polymer sample, provided that the amount of deflocculation polymer in total is sufficient to effect the desired deflocculation effects. Furthermore, any structure described herein for an individual polymer type, refers to the structure of the predominating deflocculating polymer species and the molecular weight specified is the weight average molecular weight of the deflocculation polymers in the polymer mixture.

Preferably compositions of the invention comprise a polymer of the following general formula:

$$\left[\left[A\right]_x\left[B\right]_z\right]_n$$

Wherein:

z is 1; x:z is from 1:1 to 2,000:1, preferably from 4:1 to 1,000:1 preferably from 6:1 to 250:1; in which the monomer units may be in random order; and n is at least 1;

Each A group is independently selected from the group of monomer units which are nonionic under the conditions in the liquid detergent product. Embraced in the definition of nonionic monomer units for use in compostions of the invention are monomers which are nonionic of character under most circumstances and monomer units which are anionic or cationic of character, but which are at the conditions such as pH of the product neutralised such that they have an appreciable nonionic character. Preferably the pH of the product differs at least one unit, more preferred at least two units with the $pK_a$ value corresponding to the neutralisation of the monomer unit in the polymer.

Suitable monomer units which are nonionic per se are for example ethylenically unsaturated amides such as acrylamide, methacrylamide and fumaride and their N-substitued derivatives such as N-(dimethyl amino ethyl)acrylamide, vinyl alcohol, vinyl heterocyclic amides such as vinyl pyrrolidone, acrolein, allyl alcohol, hydroxy ethyl (meth) acrylate, hydroxy propyl (meth)acrylate, sugar units such as saccharides and glucosides, glycerol or other polyalcohols.

Suitable monomer units which are anionic at certain conditions, but which have an appreciable nonionic character at relatively low pH values of the product are for example: ethylenically unsaturated carboxylic acids, dicarboxylic acids such as acrylic acid, maleic acid, methacrylic acid, itaconic acid, fumaric acid, crotonic acid, aconitic acid and citraconic acid.

Suitable monomer units which are cationic under certain conditions, but which have an appreciable nonionic character at relatively high pH values are for example: amino alkyl esters of unsaturated carboxylic acids such as 2-amino ethyl (metha)crylate, dimethyl amino ethyl (meth)acrylate, diethyl amino ethyl (meth)acrylate, dimethyl amino methyl (meth) acrylate, diethyl amino ethyl (meth)acrylate, vinyl or alkyl amines such as vinyl pyridine, vinyl morpholine or allylamine.

Also mixtures of nonionic monomers may be used.

B is a monomer unit which is ionic under the conditions of the product, again the monomer units may be ionic under most circumstances, but also possible is the use of monomer units which only become ionised under the pH conditions of the product. If such ionisable monomer units are used, then preferably the pH of the product should differ at least one unit, more preferred at least two units with the $pK_a$ corresponding to the ionisation of the monomer in the polymer.

Examples of generally ionised monomer units are N(trimethylammoniumethyl) acrylamide chloride or sulphate, N(trimethyl ammonium propyl) acrylamide chloride or sulphate, 2-suphato ethyl (meth)acrylate and its ammonium, alkali metal or alkali earth metal salts, or can be obtained by conversion reactions of monomers A such as the cationisation of sugar units with 2,3 epoxypropyl trimethyl ammonium chloride, other ethylenically unsaturated quaternary ammonium compounds such as vinyl benzyl trimethyl ammonium chloride, the quaternary ammonium salts of di methyl/ethyl amino methyl/ethyl (meth)acrylate, vinyl aryl sulphonates such as vinyl benzyl sulphonate, sodium vinyl sulphonate, sodium alkyl sulphonate, beta-styrene phosphonic acid, sodium-p styrene sulphonate and vinyl phosphonic acid.

Examples of monomer units which have an appreciable ionised character at relativly high pH values are ethylenically unsaturated carboxylic acids, dicarboxylic acids such as acrylic acid, maleic acid, methacrylic acid, itaconic acid, fumaric acid, crotonic acid, aconitic acid and citralinic acid.

Suitable monomer units which which have an appreciable ionised character at relatively low pH values are for example: amino alkyl esters of unsaturated carboxylic acids such as 2-amino ethyl (metha)crylate, dimethyl amino ethyl (meth)acrylate, diethyl amino ethyl (meth)acrylate, dimethyl amino methyl (meth) acrylate, diethyl amino ethyl (meth-)acrylate, vinyl or alkyl amines such as vinyl pyridine, vinyl morpholine or allylamine.

Also mixtures of monomer units may be used.

Preferably the monomers for use in polymers in accordance with the invention are sufficiently hydrophilic to form at least a 1% by weight solution when dissolved in water of ambient temperature and of the pH of the final product.

Preferably polymers for use in compositions of the invention contain at least two different monomers. The first of these monomers is preferably of nonionic character as defined hereinabove, the second monomer is preferably ionic under most circumstances as defined hereinabove. Most preferably the ionic monomer is a cationic monomer. Preferably the amount of ionic monomers in the polymer is from 0.1 to 50% by weight of the polymer, more preferred from 1 to 25%, most preferred from 4 to 15%.

In specific the following types of polymers are preferred

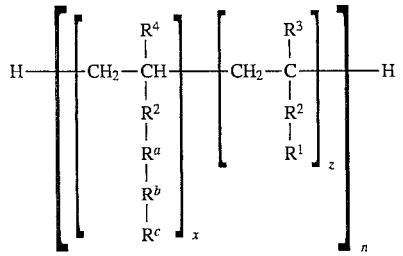

(I)

wherein:

x, z and n are as above;

$R^3$ and $R^4$ represent hydrogen or $C_{1-4}$ alkyl;

$R^2$ represents —CO—O—, —O—, —O—CO—, —$CH_2$—, —CO—NH—, or is absent;

$R^1$ represents —$C_3H_6$—$N^+$—$(CH_3)_3$ ($Cl^-$) , —$C_2H_4$—$OSO_3$ ($Na^+$), —$SO_3^-$($Na^+$), —$C_2H_4$ $N^+(CH_3)_3$ $Cl^-$, —$C_2H_4$ $N^+(C_2H_6)_3$ $Cl^-$, —$CH_2N^+(CH_3)_3$ $Cl^-$, —$CH_2$ $N+(C_2H_6)_3Cl^-$ or benzyl-$SO_3$ ($Na^+$);

$R^a$ is $CH_2$, $C_2H_4$, $C_3H_6$ or is absent;

$R^b$ represents form 1 to 50 independently selected alkylene oxide groups, preferably ethylene oxide groups or is absent;

$R^c$ represents —OH or —H; and wherein if $R^2$, $R^a$ and $R^b$ are absent, then $R^c$ is not —H.

intrinsic viscosity method measured by the absolute intrinsic viscosity method described by Noda, Tsoge and Nagasawa in Journal of Physical Chemistry, Volume 74, (1970), pages 710–719.

The polymers for use in compositions of the present invention may be prepared in analogy of conventional polymerisation methods.

Generally, the deflocculating polymer will be used at from 0.01% to 5.0% by weight of the composition, most preferably from 0.1% to 2.0%.

Although it is possible to form lamellar dispersions of surfactant in water alone, in many cases it is preferred for the aqueous continuous phase to contain dissolved electrolyte. As used herein, the term electrolyte means any ionic water-soluble material. However, in lamellar dispersions, not all the electrolyte is necessarily dissolved but may be suspended as particles of solid because the total electrolyte concentration of the liquid is higher than the solubility limit of the electrolyte. Mixtures of electrolytes also may be used, with one or more of the electrolytes being in the dissolved aqueous phase and one or more being substantially only in the suspended solid phase. Two or more electrolytes may also be distributed approximately proportionally, between these two phases. In part, this may depend on processing, e.g. the order of addition of components. On the other hand, the term 'salts' includes all organic and inorganic materials which may be included, other than surfactants and water, whether or not they are ionic, and this term encompasses the sub-set of the electrolytes (water-soluble materials).

The only restriction on the total amount of detergent-active material and electrolyte (if any) is that in the com-

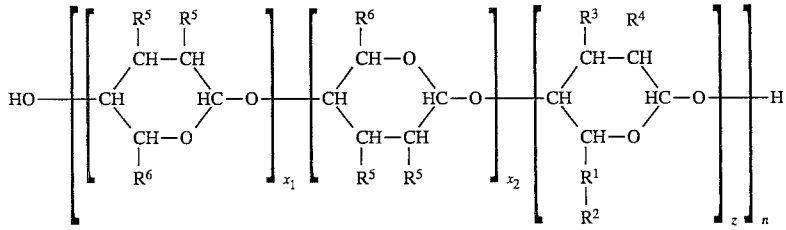

(II)

Wherein:

$x=x_1+x_2$ x,z and n are as defined above $R^1$ represents —$CH_2O$— or —O—;

$R^2$ represents —$CH_2COO^-Na$+, —$C_3H_6ON^+(CH_3)_3Cl^-$ or —$C_3H_6N^+(CH_3)_3Cl^-$ $R^3$ and $R^4$ represents —OH, $CH_2OH$, —$O(C_3H_6O)_p$-H, —$CH_2$—$O(C_3H_6O)_p$-H or —$OCH_2COO^-Na^+$, —O—$C_3H_6ON^+(CH_3)_3Cl^-$ or —O—$C_3H_6N^+(CH_3)_3Cl^-$ $R^5$ represents —OH, —NH—CO—$CH_3$ or —O$(C_3H_6O)_p$-H $R^6$ represents —OH, —$CH_2OH$, —$CH_2$—$OCH_3$, —$O(C_3H_6O)_p$—H or —$CH_2$—O—$(C_3H_6O)_p$—H p is from 1–10.

Preferably compositions according to the present invention have a pH of less than 12.5, more preferred less than 11.0. Most preferred from 7.0 to 10.5.

For the polymers of formula (I–II) and their salts, it is preferred to have a weight average molecular weight in the region of from 500 to 500,000, most preferably from 1,000 to 250,000, especially from 2,000 to 30,000 when measured by GPC using polyacrylate standards or by measurements of the S.V.. For the purposes of this definition, the molecular weights of the standards are measured by the absolute positions of the invention, together they must result in formation of an aqueous lamellar dispersion. Preferably the level of electrolyte is more than 1%, more preferred more than 2%, especially preferred from 5–40% by weight of the composition.

Thus, within the ambit of the present invention, a very wide variation in surfactant types and levels is possible. The selection of surfactant types and their proportions, in order to obtain a stable liquid with the required structure will be fully within the capability of those skilled in the art. However, it can be mentioned that an important sub-class of useful compositions is those where the detergent-active material comprises blends of different surfactant types. Typical blends useful for fabric washing compositions include those where the primary surfactant(s) comprise nonionic and/or a non-alkoxylated anionic and/or an alkoxylated anionic surfactant.

In many (but not all) cases, the total detergent-active material may be present at from 2% to 60% by weight of the total composition, for example from 5% to 40% and typically from 10% to 30% by weight. However, one preferred class of compositions comprises at least 20%, most preferably at least 25%, and especially at least 30% of detergent-active material based on the weight of the total composition.

In the case of blends of surfactants, the precise proportions of each component which will result in such stability and viscosity will depend on the type(s) and amount(s) of the electrolytes, as is the case with conventional structured liquids.

In the widest definition the detergent-active material in general, may comprise one or more surfactants, and may be selected from anionic, cationic, nonionic, zwitterionic and amphoteric species, and (provided mutually compatible) mixtures thereof. For example, they may be chosen from any of the classes, sub-classes and specific materials described in 'Surface Active Agents' Vol. I, by Schwartz & Perry, Interscience 1949 and 'Surface Active Agents' Vol. II by Schwartz, Perry & Berch (Interscience 1958), in the current edition of "McCutcheon's Emulsifiers & Detergents" published by the McCutcheon division of Manufacturing Confectioners Company or in 'Tensid-Taschenbuch', H.Stache, 2nd Edn., Carl Hanser Verlag, München & Wien, 1981.

Preferably the ionic character of the ionic groups of the deflocculating polymer is chosen such that these groups may be linked to the surfactant materials in the compostion. For example if the surfactant materials in the liquid detergent composition are anionic, optionally combined with nonionic surfactant materials, then the ionic monomers in the deflocculating polymers are preferably positively charged and vice versa.

Suitable nonionic surfactants include, in particular, the reaction products of compounds having a hydrophobic group and a reactive hydrogen atom, for example aliphatic alcohols, acids, amides or alkyl phenols with alkylene oxides, especially ethylene oxide, either alone or with propylene oxide. Specific nonionic detergent compounds are alkyl ($C_6$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long-chain tertiary phospine oxides and dialkyl sulphoxides.

Suitable anionic surfactants are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced, for example, from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralized with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolyzing with a base to produce a random sulphonate; and olefin sulphonates, which term is used to describe the material made by reacting olefins, particularly $C_{10}$–$C_{20}$ alpha-olefins, with $SO_3$ and then neutralizing and hydrolyzing the reaction product. The preferred anionic detergent compounds are sodium ($C_{11}$–$C_{15}$) alkyl benzene sulphonates and sodium ($C_{16}$–$C_{18}$) alkyl sulphates.

Suitable surfactants also include stabilising surfactants preferably having a salting out resistance—as defined in our copending European patent application EP 328 177—of more than 6.4. Some preferred classes of stabilising surfactants are: alkyl amine oxides; alkyl polyalkoxylated carboxylates; alkyl polyalkoxylated phosphates; alkyl polyalkoxylated sulphosuccinates; dialkyl diphenyloxide disulphonates; and alkyl polysaccharides (sometimes called alkyl polyglucosides or polyglycosides); selected as those which have a salting out resistance of at least 6.4.

A wide variety of such stabilising surfactants is known in the art, for example the alkyl polysaccharides described in European patent specification nos. EP-A-70 074; 70 075; 70 076; 70 077; 75 994; 75 995; 75 996 and 92 355. The use of these materials is especially preferred for environmental reasons.

It is also possible, and sometimes preferred, to include an alkali metal soap of a mono- or di- fatty acid, especially a soap of an acid having from 12 to 18 carbon atoms, for example oleic acid, ricinoleic acid, and fatty acids derived from castor oil, rapeseed oil, groundnut oil, coconut oil, palmkernel oil or mixtures thereof. The sodium or potassium soaps of these acids can be used.

Some or all of the electrolyte or any substantially water-insoluble salt which may be present in compositions of the invention, may have detergency builder properties. In any event, it is preferred that compositions according to the present invention include detergency builder material, some or all of which may be electrolyte. The builder material is any capable of reducing the level of free calcium ions in the wash liquor and will preferably provide the composition with other beneficial properties such as the generation of an alkaline pH, the suspension of soil removed from the fabric and the dispersion of the fabric softening clay material.

Examples of phosphorous-containing inorganic detergency builders, when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates. Phosphonate sequestrant builders may also be used.

Examples of non-phosphorus-containing inorganic detergency builders, when present, include water-soluble alkali metal carbonates, bicarbonates, silicates and crystalline and amorphous aluminosilicates. Specific examples include sodium carbonate (with or without calcite seeds), potassium carbonate, sodium and potassium bicarbonates, silicates and zeolites.

In the context of inorganic builders, we prefer to include electrolytes which promote the solubility of other electrolytes, for example use of potassium salts to promote the solubility of sodium salts. Thereby, the amount of dissolved electrolyte can be increased considerably (crystal dissolution) as described in UK patent specification GB 1 302 543.

Examples of organic detergency builders, when present, include the alkaline metal, ammonium and substituted ammonium polyacetates, carboxylates, polycarboxylates, polyacetyl carboxylates and polyhydroxysulphonates. Specific examples include sodium, potassium, lithium, ammonium and substituted ammonium salts of ethylenediaminetetraacetic acid, nitrilitriacetic acid, oxydisuccinic acid, tartrate mono succinate, tartrate di succinate, CMOS, melitic acid, benzene polycarboxylic acids and citric acid.

In the context of organic builders, it is also desirable to incorporate polymers which are only partly dissolved in the aqueous continuous phase as described in our UK patent application No. 8718216 (corresponding to EP 301 882). This allows a viscosity reduction (owing to the polymer which is dissolved) whilst incorporating a sufficiently high amount to achieve a secondary benefit, especially building, because the part which is not dissolved does not bring about the instability that would occur if substantially all were dissolved.

Also other polymers may be incorporated in compositions of the present invention, particularly advantageous is the use of polymers as described in EP 301 883.

Although it is possible to incorporate minor amounts of hydrotropes such as lower alcohols (e.g. ethanol) or alkanolamines (e.g. triethanolamine), in order to ensure integrity of the lamellar dispersion we prefer that the compositions of the present invention are substantially free from hydrotropes. By hydrotrope is meant any water soluble agent which tends to enhance the solubility of surfactants in aqueous solution.

Apart from the ingredients already mentioned, a number of optional ingredients may also be present, for example lather boosters such as alkanolamides, particularly the monoethanolamides derived from palm kernel fatty acids and coconut fatty acids, fabric softeners such as clays, amines and amine oxides, lather depressants, oxygen-releasing bleaching agents such as sodium perborate and sodium percarbonate, peracid bleach precursors, chlorine-releasing bleaching agents such as trichloroisocyanuric acid, inorganic salts such as sodium sulphate, and, usually present in very minor amounts, fluorescent agents, perfumes, enzymes such as proteases, amylases and lipases (including Lipolase (Trade Mark) ex Novo), germicides and colourants.

Amongst these optional ingredients, as mentioned previously, are agents to which lamellar dispersions without deflocculating polymer are highly stability-sensitive and by virtue of the present invention, can be incorporated in higher, more useful amounts. These agents cause a problem because they tend to promote flocculation of the lamellar droplets. Examples of such agents are fluorescers like Blankophor RKH, Tinopal LMS, and Tinopal DMS-X and Blankophor BBM as well as metal chelating agents, especially of the phosphonate type, for example the Dequest range sold by Monsanto.

Compositions of the invention may be prepared in analogy to conventional methods for the preparation of liquid detergent compositions. A preferred method of preparing compositions of the present invention involves the addition of the water-soluble electrolyte —if any—to water, followed by the addition of any water-insoluble material such as aluminosilicates, followed by the polymer ingredients and finally the surfactant ingredients. Another preferred method of preparing a composition of the present invention involves the addition of the surfactant ingredients to water at ambient temperature, followed by the addition of the polymer ingredients, and the cooling of the mixture to below 30° C., whereafter the remaining ingredients are added. Finally, if necessary, the pH of the composition may be adjusted, e.g. by the addition of small quantities of caustic materials.

The following names refer to trademarks: Lipolase Blankophor RKH, Tinopal LMS, Tinopal DMS-X, Blankophor BBM, Dequest, Synperonic A7 and Jaguar C—13—S.

The invention will now be illustrated by way of the following Examples. In all Examples, unless stated to the contrary, all percentages are by weight.

A. Base formulations

TABLE 1

Composition of basic formulation i.e without deflocculating polymers

| | Basic formulation 1 | Basic formulation 2 |
|---|---|---|
| Ingredient | | |
| Na Dobs | 24.5 | 26.1 |
| Synperonic A7 | 9.9 | 10.5 |
| Na citrate | 16.4 | 10.9 |
| water | 49.2 | 52.5 |
| polymer | weights additional to basic formulation | |
| Raw material Specification | | |
| Na Dobs | Na Dodecyl Benzene sulphonate | |
| Synperonic A7 | $C_{12-15}$ ethoxylated alcohol, 7EO, ex. ICI. | |

EXAMPLES 1–5

| Example | Basic Composition | Polymer Type | Polymer % | Product Stability | Product Visc mPas at 21 $s^{-1}$ |
|---|---|---|---|---|---|
| Reference | 2 | — | — | unstable | 1380 |
| 1 | 2 | i* | 4.0 | stable | 1930 |
| 2 | 2 | II** | 0.25 | stable | 1480 |
| 3 | 2 | II** | 0.50 | stable | 3330 |
| Reference | 1 | — | — | unstable | 2560*** |
| 4 | 1 | II** | 0.25 | stable | 1240 |
| 5 | 1 | II** | 0.50 | stable | 3510 |

* $R^1 = —(CH_2)_3—N^+—(CH_3)_3Cl^-$
$R^2 = —CO—NH—$
$R^3 = —CH_3$
$R^4 = —H$
$R^a$ and $R^b$ are absent;
$R^c$ is —H
x = 25
Molecular weight = 2.8 K.
**$R^1 = —CH_2O—$,
$R^2 = —C_3H_6ON^+(CH_3)_3Cl^-$,
$R^3 = R^4 = —OH$,
$R^5 = —OH$,
$R^6 = —CH_2OH$,
$x_1 = x_2$,
x = 7–8,
molecular weight = 200K.
The polymer is commercially available under the tradename Jaguar C-13-S, ex Meyhall
***Unreliable result due to rapid phase separation

We claim:

1. A liquid detergent composition comprising a dispersion of lamellar droplets comprising bi-layers of surfactant material in an aqueous continuous phase, from 5–40% by weight of electrolyte and from 0.01 to 5.0% by weight of the composition of a deflocculating polymer, characterized in that the polymer consists of nonionic monomers and ionic monomers wherein the ionic monomers constitute from 0.1 to 50% by weight of the polymer, and are selected from the group consisting of polymers having the formula:

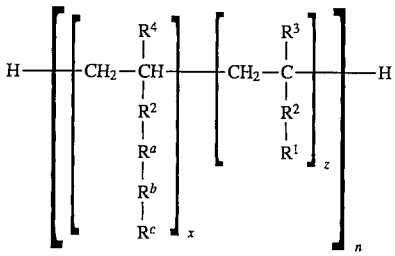

(I)

wherein:

z is 1, x:z is from 4:1 to 2,000:1, and n is at least 1;

$R^3$ and $R^4$ represent hydrogen or $C_{1-4}$ alkyl;

$R^2$ represents—CO—O—, —O—, —O—CO—, —$CH_2$—, —CO—NH—, or is absent;

$R^1$ represents —$C_3H_6$—$N^+$—$(CH_3)_3(Cl^-)$, —$C_2H_4$—$OSO_3$—$(Na^+)$, —$SO_3$—$(Na^+)$, —$C_2H_4N^+(CH_3)_3Cl^-$, —$C_2H_4N^+(C_2H_6)_3$ $Cl^-$, —$CH_2N^+(CH_3)_3$ $Cl^-$, —$CH_2N^+(C_2H_6)_3Cl^-$ or benzyl-$SO_3^-(Na^+)$;

$R^a$ is $CH_2$, $C_2H_4$, $C_3H_6$ or is absent;

$R^b$ represents from 1 to 50 independently selected alkylene oxide groups, or is absent;

$R^c$ represents —OH or —H;

and wherein if $R^2$, $R^a$ and $R^b$ are absent, then $R^c$ is not —H;

said polymer having a weight average molecular weight of from 500 to 5000,000.

2. A liquid detergent composition according to claim 1 containing from 2–60% by weight of detergent active materials.

* * * * *